US006780101B2

(12) United States Patent
Buhler et al.

(10) Patent No.: US 6,780,101 B2
(45) Date of Patent: Aug. 24, 2004

(54) DRYING BAG FOR SPORTS EQUIPMENT AND THE LIKE

(75) Inventors: Randal W. Buhler, Manitoba (CA); Richard D. Doerksen, Manitoba (CA); James Kor, Manitoba (CA); Terry E. Halajko, Manitoba (CA)

(73) Assignee: 4344953 Manitoba Ltd., Winnipeg (CA)

( * ) Notice: Subject to any disclaimer, the term of this patent is extended or adjusted under 35 U.S.C. 154(b) by 0 days.

(21) Appl. No.: 10/311,372

(22) PCT Filed: Jun. 14, 2001

(86) PCT No.: PCT/CA01/00919

§ 371 (c)(1),
(2), (4) Date: Dec. 16, 2002

(87) PCT Pub. No.: WO01/96646

PCT Pub. Date: Dec. 20, 2001

(65) Prior Publication Data

US 2003/0145483 A1 Aug. 7, 2003

Related U.S. Application Data

(60) Provisional application No. 60/211,485, filed on Jun. 14, 2000.

(51) Int. Cl.[7] ..... F26B 7/00

(52) U.S. Cl. ..... 454/437; 454/443; 454/90; 454/104; 454/390

(58) Field of Search ..... 34/202, 218, 232, 34/235, 60, 72, 90, 104, 390, 404, 418, 427, 437, 443, 467, 487, 516, 618, 619, 621, 622

(56) References Cited

U.S. PATENT DOCUMENTS

| | | | | | |
|---|---|---|---|---|---|
| 2,793,444 | A | | 5/1957 | Turner | |
| 3,739,492 | A | | 6/1973 | Brooks | |
| 4,064,203 | A | * | 12/1977 | Cox | 261/99 |
| 4,572,364 | A | | 2/1986 | Jordan | |
| 4,959,911 | A | | 10/1990 | Wolens et al. | |
| 5,014,446 | A | * | 5/1991 | Reesman | 34/620 |
| 5,528,840 | A | | 6/1996 | Pajak et al. | |
| 5,555,648 | A | | 9/1996 | Griffin | |
| 5,730,006 | A | | 3/1998 | Conley | |
| 5,930,915 | A | | 8/1999 | Dhaemers | |
| 5,932,147 | A | * | 8/1999 | Chen | 261/30 |
| 6,134,806 | A | * | 10/2000 | Dhaemers | 34/404 |
| 6,263,591 | B1 | * | 7/2001 | La Porte | 34/622 |

FOREIGN PATENT DOCUMENTS

| | | | | |
|---|---|---|---|---|
| GB | 2307399 | | 5/1997 | |
| JP | 2002357344 | A * | 12/2002 | F24F/7/013 |

* cited by examiner

*Primary Examiner*—Jiping Lu
(74) *Attorney, Agent, or Firm*—Adrian D. Battison; Michael R. Williams; Ryan W. Dupuis

(57) ABSTRACT

An apparatus and method is provided for drying and/or scenting sports equipment and the like. A sports bag is designed such that it has two openings which are covered by a mesh fabric or a rigid plastic screen. One opening is used to receive a blower fan engaged onto the mounting at the opening. The other opening is used to allow air to escape. Wet and/or foul smelling sports equipment is placed into the sports bag. An air freshener is inserted into a pocket located in the blower fan housing, or near to the opening of the intake opening of the sports bag. The fan is turned on (with or without a timer). In a relatively short period of time the sports equipment is dry, with little effort required or foul odor released outside the sports bag.

13 Claims, 7 Drawing Sheets

DRYING BAG FOR SPORTS EQUIPMENT AND THE LIKE

This application claims priority under 35 U.S.C. 119 from United States Provisional Application Serial No. 60/211,485 filed Jun. 14, 2000.

The present invention relates to sports equipment bags and more particularly to a novel method to expand the use of sports bag from transport/protection utility only to also drying and optional scenting utility.

Sports equipment, and notably hockey and football equipment, is often comprised of many items for the individual user. Together these many items make for a bulky and unwieldy combination of items to move from place to place. Thus, this sports equipment is usually transported in a bag.

Sports equipment has a near legendary reputation for becoming wet from sweat, and for becoming foul-smelling as well. The foul smelling sports equipment, and the space necessary to dry it, is currently an ongoing source of conflict in many living situations. Players are often forced to dry their sports equipment in risky, unsuitable, or destructive environments, such as back yards, garages, balconies, where they may be subject to theft or cold or damp weather.

Also, since many games are played in close proximity to each other from a time perspective, a player often does not have enough time to dry the equipment before the next use. This makes for a clammy and unpleasant feeling; putting on wet equipment.

In current practice, the problems of wetness and foul smell are addressed in the following ways.

For wetness, the sports equipment is removed from the sports bag, and spread out to dry on racks, on the ground, or in the sun, and then, when the equipment is dry, the equipment is placed back into the sports bag. This requires diligence and lengthy periods of time.

For foul odor, it is common practice to place aroma packs, air fresheners and the like into the sports equipment bag. However, if the sports equipment is not removed from the bag to dry, the air fresheners effect is greatly minimized.

Hanging drying and/or anti-wrinkling bags for clothes are shown in U.S. Pat. Nos. 5,555,648 (Griffin) issued Sep. 17, 1996; 5,730,006 (Conley) issued Mar. 24, 1998; 4,572,364 (Jordan) issued Feb. 25, 1986 and 3,739,492 (Brooks) issued Jun. 19, 1973 but none of these is suitable for sporting equipment including pads and the like which are awkward and bulky and many of these include heat and/or steam which are unsuitable for the sports equipment.

There remains then, an opportunity to improve the situation. The present invention allows for such improvement.

SUMMARY OF THE INVENTION

The present invention is concerned with a method and apparatus to allow wet and foul smelling sports equipment to remain in the sports bag and yet, while still remaining in the sports bag, the equipment will become dry and fairer smelling.

According to the present invention, there is provided a method for drying sporting equipment and the like comprising:

transporting the sporting equipment in a sporting equipment bag having a filler opening through which the equipment is inserted into the bag and handles for carrying the bag;

with the equipment in the bag, closing the opening of the bag;

providing an air flow opening in the bag separate from the filler opening;

attaching a blower fan to the air flow opening of the bag;

and actuating the fan to force air into the bag until the sporting equipment is dry from the air passing around the sporting equipment and escaping from the bag.

While the present invention has been described in the context of sporting equipment, it is apparent that the present invention will in practice be used to dry various items, not just sports equipment. Many other activities make use of bulky items which require drying or scenting. It will be used as a general purpose dryer.

Also, the size of the bag and fan can theoretically have no limit and be applied to many different things.

While the bag is included as an element of this construction, it will be appreciated that the present invention may be sold as a kit of parts for assembly into a bag so that an existing bag will be formed into a drying arrangement according to the present invention.

The bag may have a second air flow opening generally opposite to the first air flow opening or optionally, air may escape through the existing filler opening.

Preferably the air flow opening or openings is covered by a screen or mesh or a more rigid grid arranged to prevent the passage through the airflow opening of the equipment within the bag.

Preferably the fan includes a fan housing and wherein the airflow opening includes a peripheral engagement member engaged around a periphery of the fan housing such that the fan and fan housing are contained within the peripheral engagement member.

Preferably there is provided an air freshener in a pocket at or adjacent the bag airflow opening.

Preferably the filler opening is arranged at a top of the bag and the bag includes a bottom wall for sitting on a support surface and side walls standing upwardly from the bottom wall with the sporting equipment resting on the bottom wall and wherein the airflow opening is in one side wall.

Preferably two of the side walls are at ends that is the walls generally at right angles to the length of the handles and the airflow opening is in one end. However the openings may be located at other places in the bag wall, but generally not in the bottom where the bag can simply sit on its bottom with the equipment resting against the bottom. Such handles are generally attached to the sides or to straps extending around the sides with the insertion opening parallel to the handles but other constructions may be included.

Preferably the air flow opening includes a mounting ring having a peripheral clamping arrangement for clamping the fabric of the bag which has a first ring element on one side of the wall and a second ring element on the other side of the wall for clamping the fabric wall of the bag therebetween and the fan includes a fan housing which fits into the ring and locks in place. However the fan may also be permanently attached to the bag so as to be carried thereby and be available at all times and places for the drying action.

Preferably the ring includes a screen having a concave outside face and the fan housing includes a screen having a convex face fitting against the screen of the ring.

Preferably a second rigid ring similar to or identical to the mounting ring is arranged in a wall of the bag opposite to the mounting ring. The use of the same ring structure reduces cost of manufacture by avoiding the necessity for different parts.

Preferably there is provided an air freshener housing located on an outside face of the fan housing of the fan where the air freshener housing can be opened and closed to allow entry of more or less of the air freshener material.

According to a second aspect of the invention there is provided a fan assembly for mounting on a fabric wall of a bag comprising:

a mounting ring having a peripheral clamping arrangement for clamping the fabric of the bag for supporting the ring in a hole in the wall;

and a fan having a fan housing which fits into the ring and locks in place in the ring so as to blow air through the ring into the bag.

The purpose of the detachable fan is so that the fan can remain safely at home while the bag is in use. Also, this makes the bag lighter, not having to carry the fan around. However as an alternate embodiment it would be possible to have the fan permanently mounted. This would have the benefit of not having to attach and detach the fan, but would add slight weight to the bag.

Another option would be to secure the existing fan as described in the drawings permanently to the mounting rings by means of a bolt or screw, thus locking the fan into place.

According to a third aspect of the invention there is provided an apparatus for drying sporting equipment and the like comprising:

a sporting equipment bag having a bag bottom, bag side walls standing upwardly from the bag bottom, a closable filler opening through which the equipment is inserted into the bag and handles on the bag side walls for carrying the bag;

an air flow opening in at least one of the bag side walls separate from the filler opening;

and a blower fan for mounting into the air flow opening of the bag.

The invention as defined above may have one or more of the following advantages.

Since the equipment remains in the sports bag, extra space is not needed to dry the equipment. This also results in less conflict for those individuals who share the space in which the sports equipment would be dried by traditional methods.

Since the equipment remains in the sports bag, extra effort of spreading or hanging the equipment is not needed to dry the equipment.

Since the present invention allows for easy drying and scenting of sports equipment, the overall pleasure in participating in the sport for which the equipment is designed, is increased.

Since the equipment remains in the bag, and since it is scented during the proposed drying process, little to no foul smell is present outside the bag, quite unlike traditional drying methods.

Since the equipment can be easily dried quickly on a regular basis, the growth of bacteria on the sports equipment is greatly minimized In preferred embodiments, the blower fan would have an on-off switch and a timer. In preferred embodiments, the fan does not have a heating function, as heat drying may degrade sports equipment, especially parts made of leather. However a low heating action which does not excessively heat the equipment may also be possible.

BRIEF DESCRIPTION OF THE DRAWINGS

One embodiment of the invention will now be described in conjunction with the accompanying drawings in which.

DETAILED DESCRIPTION

Figure 1:
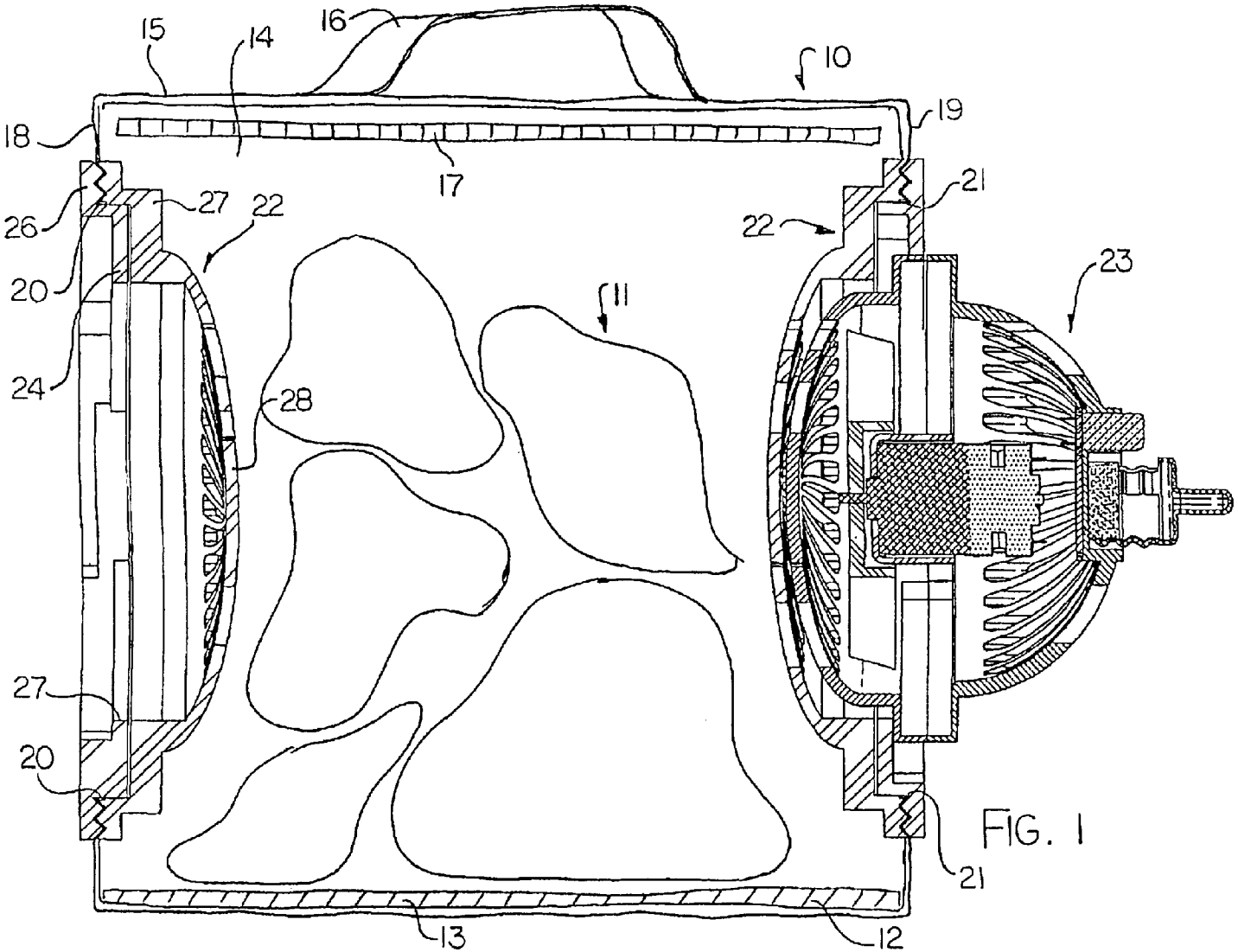
FIG. 1 is a vertical cross-sectional view through a sporting equipment bag according to the present invention.
Figure 2:
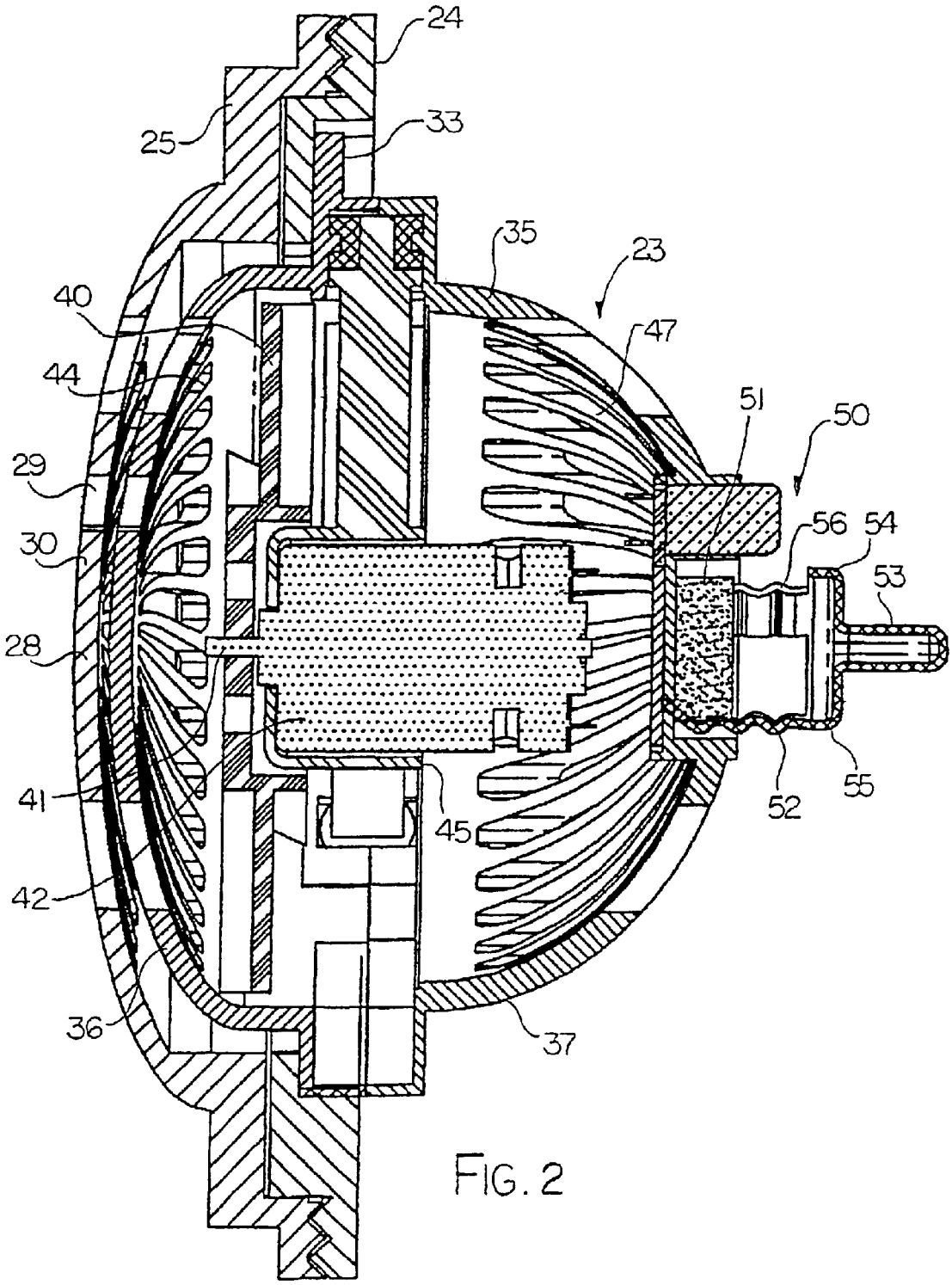
FIG. 2 is a vertical cross-sectional view through the fan and mounting ring of FIG. 1 on an enlarged scale.

A sports equipment bag is shown in FIG. 1 as indicated at 10 for receiving sports equipment schematically indicated at 11 within the bag for transportation and storage. The bag includes a bottom wall 12 which has a stiffener plate 13 so the bottom can rest upon the floor or other support surface with the sports equipment resting on the bottom in loose or random arrangement within the bag. The bag includes side walls 14 and a top 15. At the top 15 is provided one or more handles 16 by which the bag can be carried. Adjacent or at the top 15 is provided an opening 17 with a closure member in the form of a zipper by which the opening can be opened for insertion and removal of the sporting equipment and the closure member reclosed to enclose the sporting equipment.

While the bag is shown generally rectangular, in most cases the bag is relatively elongate so as to define two of the side walls 14 as end walls 18 and 19 with the handle 16 having ends at or adjacent the end walls 18 and 19 so that the bag is carried longitudinally.

The sporting equipment generally may include bulky items such as helmets, skates, pads, boots and gloves all of which are relatively bulky and thick so that they cannot be readily washed and/or tumble dried.

In the end wall 18 is provided an opening 20 which is cut into the fabric of the end wall so as to form a circular opening in which the fabric is removed. At the end wall 19 is provided a similar circular opening 21 cut in the fabric forming the end wall 19.

Each of the openings 20 and 21 is filled by a rigid plastics mounting member 22 which is clamped to the edge of the fabric surrounding the opening 20, 21 and spans the opening so as to provide a closure member for the opening.

The mounting members 22 are identical in the arrangement as shown so that each is manufactured from the same parts and each can operate interchangeably with the other. This arrangement is preferred to minimize the number of parts manufactured but it will be appreciated that only one of the mounting members cooperates, at one time, with a fan 23 which is attached to the selected mounting member so as to support the fan at the end of the bag.

The mounting member comprises an outside ring 24 and an inside ring 25 so that the outside ring is mounted on the outside surface of the bag wall and the inside ring is mounted on the inside surface of the bag wall. The inside and outside rings provide matching abutting clamping elements 26 and 27 which are annular in shape and which grasp the edge portion of the fabric at the opening. The clamping elements include rings projecting outwardly from the face of the clamping element which cooperate with recesses in the other of the clamping elements so that the fabric is clamped between the rings and recesses to be held in place around the full periphery of the opening.

The outside ring 24 has a circular opening 27 which is open and allows access to the interior of the inside ring 25 through the opening 27. The inside ring 25 includes a screen 28 spanning the opening with a screen having a plurality of slot shaped openings 29 which extend generally radially from a central closed area 30 to an outer edge 31 adjacent to but spaced inwardly from the inner edge of the outside ring 27. The slot shaped openings 29 allow the penetration of air from the exterior through the opening 27 into the interior of the bag or vice versa. The screen 28 is curved so as to define a convex surface facing inwardly into the bag and a concave surface facing outwardly of the bag. The two portions of the mounting ring are clamped together by screws 32A.

Figure 3:
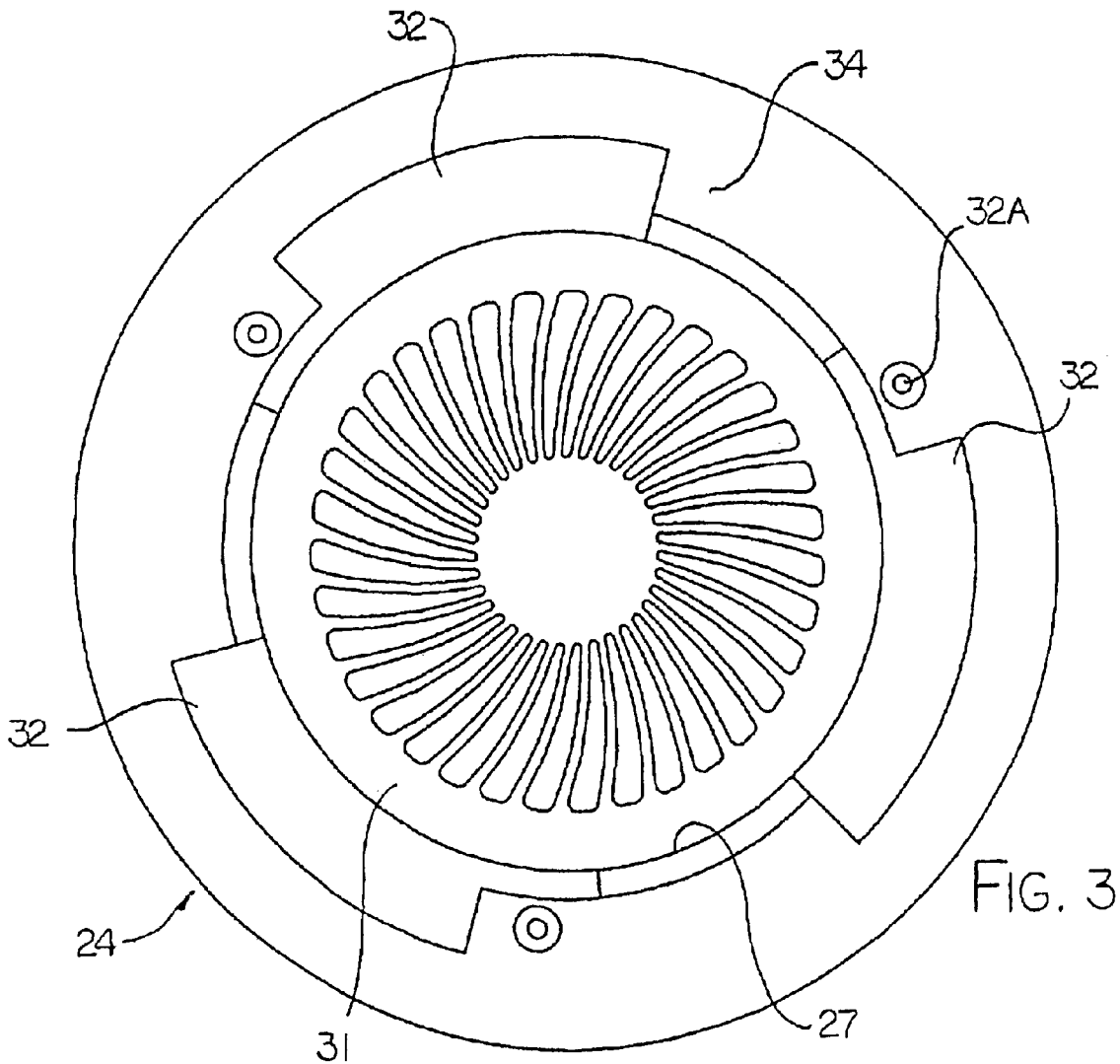
FIG. 3 is a front elevational view of the mounting ring of FIG. 1.
Figure 4:
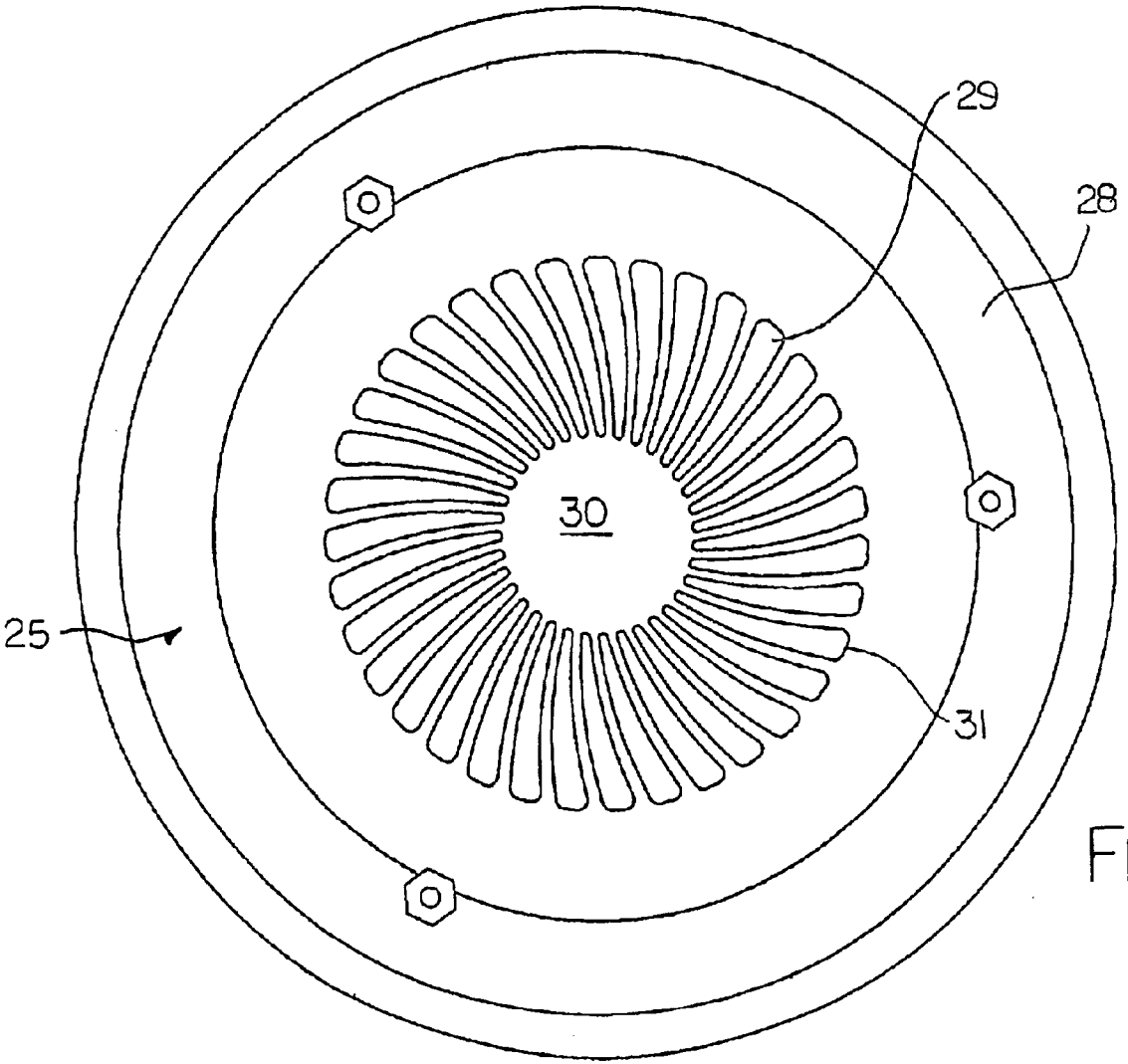
FIG. 4 is a rear elevational view of the mounting ring of FIG. 1.
Figure 5:
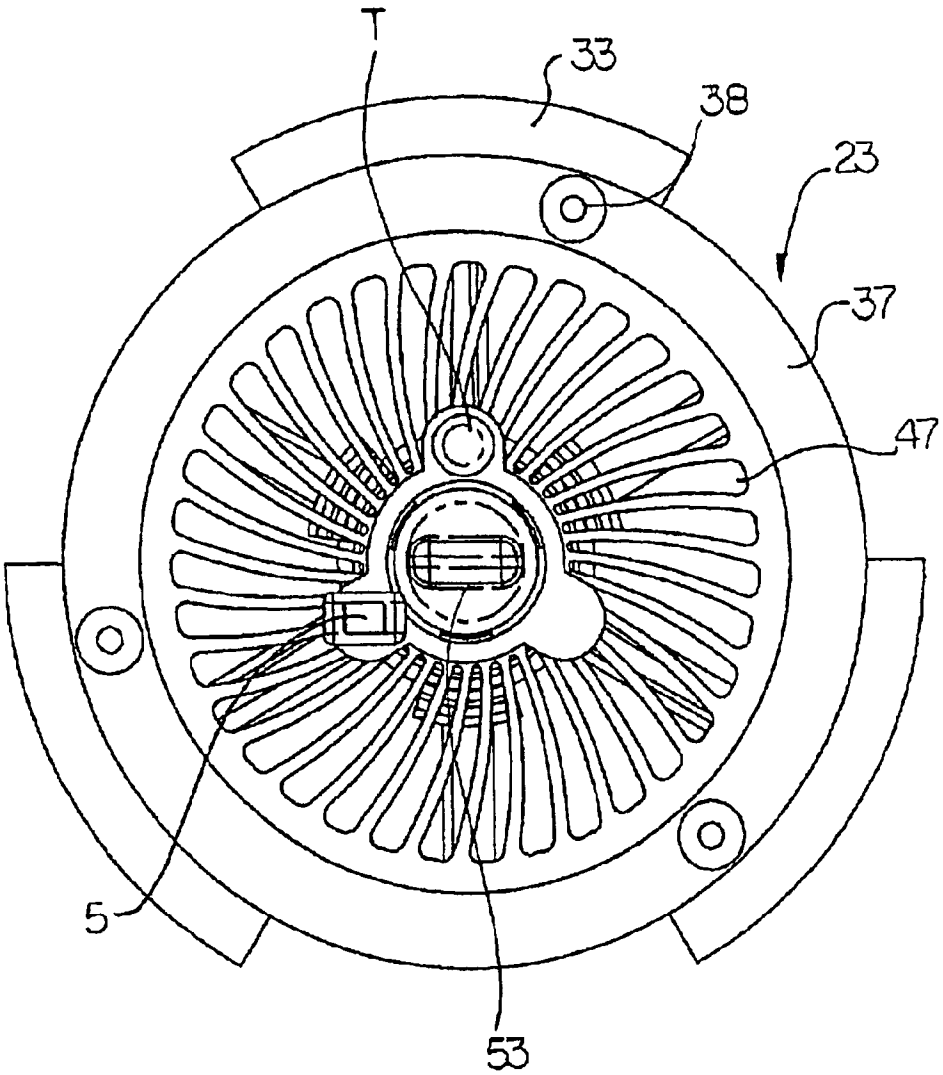
FIG. 5 is a front elevational view of the fan housing of FIG. 1.
Figure 6:
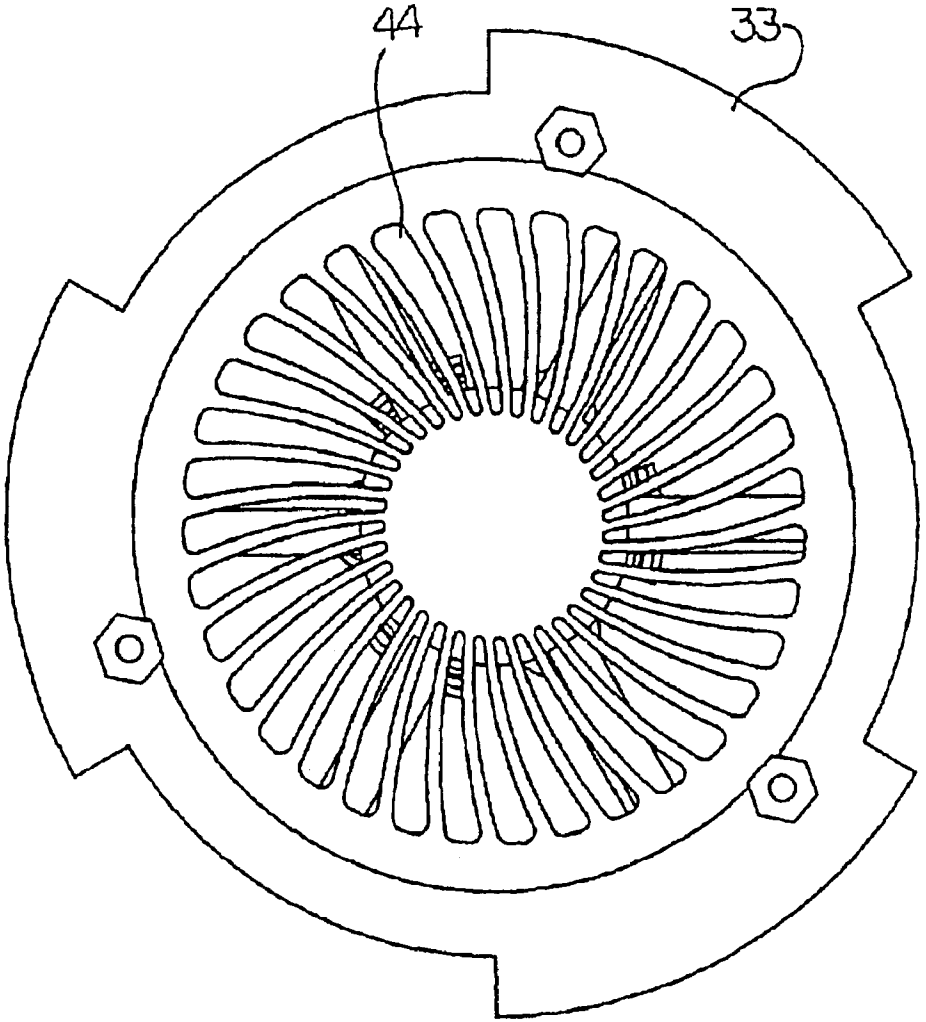
FIG. 6 is a rear elevational view of the fan housing of FIG. 1.
Figure 7:
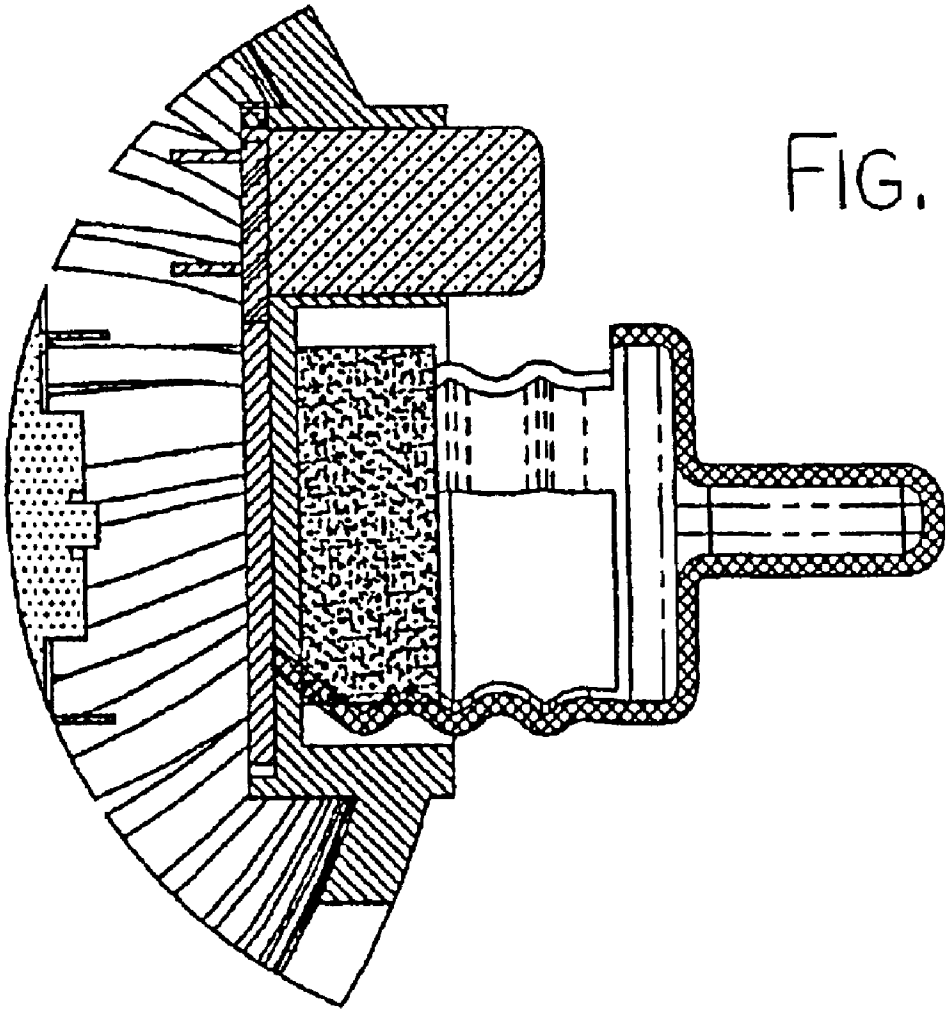
FIG. 7 is a cross-sectional view on an enlarged scale of the scent dispensing housing of the fan housing of FIG. 1.

The outside ring 24 as shown in FIG. 3 includes a multi-lobed (in the example three lobes) bayonet receptacle 32 for receiving the male lobes 33 on the peripheral edge of the fan housing 23 as shown in FIG. 5. Thus the fan housing can be mounted on either on of the mounting rings 22 and is attached simply by aligning the male lobes 33 with the female receptacles 32 and by rotating the housing so that the male lobes move behind shoulders 34 of the ring 24 to lock the lobes 33 in place on the ring 24.

The fan 23 includes a housing 35 formed by a front piece 36 and a rear piece 37 which are clamped together by screw fasteners 38.

The front portion 36 forms a domed convex shape facing forwardly of the front portion 36 so that it can closely follow the curvature of the concave surface of the mounting ring. Behind the domed front face of the fan housing is provided a fan rotor 40 mounted on a central shaft 41 of a motor 42. The fan rotor extends across the housing inside the front face so as to drive air through the housing outwardly through the front face to pass through the openings 29 of the mounting ring. The front face of the fan housing therefore has slot shaped openings 44 shaped to match and align with the openings 29 in the mounting ring.

The motor 42 is mounted within a motor mount 45 carried within the interior of the housing 35. The motor is arranged along a central axis of the fan housing behind the rotor 40 and in front of a central closed area of the rear portion 37 of the fan housing. The rear portion is also domed and includes a series of radially extending slots 47 extending outwardly from the central area to an outer periphery of the rear portion 37.

A timer T and an on/off switch S are shown schematically in FIG. 5 and are located in the central closed area of the rear portion 37 for manual operation.

Centrally of the closed central area of the rear portion 37 is provided an air freshener or scent dispensing housing 50 which contains a block of scenting material 51 which releases scenting gases. The scenting material is contained within a slidable member 52 which can be manually pulled outwardly from the central area by a manually graspable handle 53 to open the scenting housing or the housing can be closed by pushing the handle 53 inwardly so that a cover 54 moves over the scenting block 51 to cover the scenting block. The cover 54 includes sides 55 with slots 56 in the side so that air flow into the fan housing is drawn from the area over the scenting block thus tending to pull gases discharged from the scenting block into the fan housing for discharge into the bag. The amount of scenting material can thus be controlled by pulling or pushing on the handle 53 so as to open and close the slots 56 from a fully closed position in which the cover 54 covers the scenting block to a fully open position in which the slots are pulled to their maximum open width allowing the maximum air freshener material to escape.

While the above describes a particular method of dispensing scent, it is proposed that various methods of providing a controlled scent release function is possible without materially departing from the intent of the present invention.

In operation, the user of the sporting equipment when returning from a sporting event simply leaves the equipment requiring drying within the bag resting in a loose or disordered collection within the bag sitting on the bottom of the bag. The fan housing is then taken from a storage location and inserted onto a selected one of the mounting rings.

If the user desires it, the scent cavity is checked and/or loaded with a scent block, and the scent controller is set to the desired level.

The fan is then actuated by the on/off switch and/or the timer so that air is pushed through the fan housing and through the screen section of the mounting ring into the interior of the bag. That air thus tends to inflate the bag with air beyond the air necessary for the inflation escaping through the other mounting ring to maintain the bag pressurized and air flow through the materials within the bag.

When the required drying time has elapsed, the fan housing can be removed from the bag and the bag used to carry the equipment to the new location for the next sporting event. The same fan housing can of course be used on other similar bags by other persons at the same location. The fan and the fan housing is driven by mains electricity from a supply cable (NOT SHOWN).

The mounting ring at one end is shown arranged so that the fan housing can be mounted by the end of the bag. However one of the rings may be mounted in the reverse direction with the domed screen facing outwardly so as to maximize the area available within the bag. This limits the mounting of the fan housing to the other concave end.

The mounting rings and the fan housing can be readily attached to a conventional sporting equipment bag so there is no need for purchase of a special bag for use with the present invention. The conventional bag can therefore be modified simply by cutting the necessary openings at each end and by attaching the mounting rings. In practice, therefore, the mounting rings and the fan can be sold separately as items to be used as required. Thus a user could purchase additional mounting rings for additional bags which would then be used with a single fan housing which would be moved from bag to bag as required. A family having multiple bags could therefore use a single fan housing and would purchase only the single fan housing to cooperate with multiple mounting rings.

In an alternative arrangement (not shown) the inlet opening can be formed of fabric in a specially designed bag where the opening preferably has a closure around the opening which allows it to be clamped around the lip or concave outer surface of the fan. Thus it may include an elastically pulled lip sticking out from the outer edge of a fabric mesh cover to engage over the fan, or may include a draw string in a sleeve at the edge of the lip. Thus the fan is held in place firmly at the end of the bag and the bag can expand under air pressure to allow drying throughout the equipment.

The equipment is transported in the same bag simply by disconnecting the fan and picking up the bag by the handles. There is no need to remove or handle the equipment before or after drying. Surprisingly, the bag which is substantially closed apart from the inlet and a similarly sized outlet, causes pressure and air flow within the bag to cause the drying air to permeate throughout the equipment, even into skate boots.

A particularly important discovery has been made in the development of the present invention. It was expected that the present invention would not work very well because sports equipment is often densely packed within a sports bag. The question was how well could room-temperature forced air dry very wet sports equipment which was tightly packed? Also, how could fresh air be introduced into cavities such as the inside of hockey skates and the like?

As experiments showed, it appears that the pressure created by the fan, (the bag puffs up quite noticeably) allows air to be "forced" throughout the whole interior of the bag, and throughout all of the equipment, almost regardless of how tightly packed they were.

It is preferred not to use a heater in the fan because, in practice, in addition to the added cost to manufacture the blower fan, the life span of some sports equipment decreases when dried with heat and drying occurs quite rapidly without heated air.

It must be noted that many placement options for the openings on the bag, the size of the fan, and the placement of the air freshener and its pocket, the shape and position of the fan/fan housing, the type of fan blade and motor, the shape, size, and placement of the connecting apparatus can be made without materially departing from the intent of the present invention. For example, the connecting apparatus could be friction fit like a vacuum cleaner hose, slide fit, snap on, etc.

What is claimed is:

1. Apparatus for drying sporting equipment comprising:

a bag formed of a flexible fabric material having a bag bottom, fabric bag side walls standing upwardly from the bag bottom, a closable filler opening through which the equipment is inserted into the bag and handles on the bag side walls for carrying the bag;

an air flow opening defined in a bag side wall separate from the filler opening;

a peripheral mounting member having a peripheral clamping collar clamped onto the bag side wall so as to peripherally surround the opening;

and a fan having a fan rotor driven by a fan motor mounted in a fan housing;

the fan housing being separate from the mounting member;

the fan housing having an outer peripheral mounting coupling surrounding the fan housing and surrounding the fan rotor therein;

the outer peripheral mounting coupling of the fan housing being arranged to engage with a cooperating mounting coupling on the peripheral mounting member so as to readily releasable lock the fan housing in place in the mounting member so as to locate the fan rotor at the opening to blow air through the opening into the bag;

the fan housing including a front perforated screen in front of the fan rotor;

and the peripheral mounting member including a perforated screen at the opening and bridging across the opening.

2. The apparatus according to claim 1 wherein the mounting member has a first clamping element on an inner surface of said bag wall and a second clamping element on the outer surface of said bag wall for clamping said bag wall therebetween.

3. The apparatus according to claim 1 wherein the perforated screen of the mounting member has a concave outside face and the perorated screen of the fan housing has a convex face fitting against the perforated screen of the mounting member.

4. The apparatus according to claim 1 wherein a second peripheral mounting member identical to said peripheral mounting member is arranged in a wall of the bag opposite to said peripheral mounting member.

5. The apparatus according to claim 1 wherein there is provided an air freshener housing located on the fan housing.

6. The apparatus according to claim 5 wherein the air freshener housing is located on an outside face of the fan housing.

7. The apparatus according to claim 5 wherein the air freshener housing can be opened and closed to allow entry into the bag of a variable amount of an air freshener material evaporated from the air freshener housing.

8. Apparatus for mounting at an air flow opening defined in a bag side wall comprising;

a peripheral mounting member having a peripheral clamping collar arranged to be clamped onto the bag side wall so as to peripherally surround the opening;

and a fan having a fan rotor driven by a fan motor mounted in a fan housing;

the fan housing being separate from the mounting member;

the fan housing having an outer peripheral mounting coupling surrounding the fan housing and surrounding the fan rotor therein;

the outer peripheral mounting coupling of the fan housing being arranged to engage with a cooperating mounting coupling on the peripheral mounting member so as to readily releasable lock the fan housing in place in the mounting member so as to locate the fan rotor at the opening to blow air through the opening into the bag;

the fan housing including a front perforated screen in front of the fan rotor;

and the peripheral mounting member including a perforated screen at the opening and bridging across the opening.

9. The apparatus according to claim 8 wherein the mounting member has a first clamping element and a second clamping element for clamping said bag wall therebetween.

10. The apparatus according to claim 8 wherein the perforated screen of the mounting member has a concave outside face and the perorated screen of the fan housing has a convex face fitting against the perforated screen of the mounting member.

11. The apparatus according to claim 8 wherein there is provided an air freshener housing located on the fan housing.

12. The apparatus according to claim 11 wherein the air freshener housing is located on an outside face of the fan housing.

13. The apparatus according to claim 11 wherein the air freshener housing can be opened and closed to allow entry into the bag of a variable amount of an air freshener material evaporated from the air freshener housing.

* * * * *